US007737939B2

(12) United States Patent
Shin et al.

(10) Patent No.: US 7,737,939 B2
(45) Date of Patent: Jun. 15, 2010

(54) DISPLAY DRIVER IC AND DISPLAY DRIVING METHOD FOR SUPPORTING VARIOUS DRIVING MODES

(75) Inventors: Dong-hyuk Shin, Yongin-si (KR); Jae-youn Lee, Yongin-si (KR); Jee-hwal Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 790 days.

(21) Appl. No.: 11/564,884

(22) Filed: Nov. 30, 2006

(65) Prior Publication Data

US 2007/0165014 A1 Jul. 19, 2007

(30) Foreign Application Priority Data

Jan. 16, 2006 (KR) ..... 10-2006-0004443

(51) Int. Cl.
*G09G 3/36* (2006.01)

(52) U.S. Cl. ..... 345/103; 345/204; 345/100

(58) Field of Classification Search ..... 345/1.1, 345/1, 2, 1.3, 204, 103, 212–214, 1.2
See application file for complete search history.

(56) References Cited

U.S. PATENT DOCUMENTS 5,136,282 A * 8/1992 Inaba et al. ..... 345/97
5,376,944 A * 12/1994 Mogi et al. ..... 345/100
5,726,677 A * 3/1998 Imamura ..... 345/99
5,945,974 A * 8/1999 Sharma et al. ..... 345/98
7,023,419 B2 * 4/2006 Park ..... 345/103
7,298,354 B2 * 11/2007 Yang ..... 345/90

FOREIGN PATENT DOCUMENTS

| | | |
|---|---|---|
| JP | 07-175451 | 7/1995 |
| JP | 09-006278 | 1/1997 |
| JP | 09-330054 | 12/1997 |
| KR | 1020000021177 | 4/2000 |

OTHER PUBLICATIONS

English Abstract for Publication No. 07-175451, Jul. 14, 1995.
English Abstract for Publication No. 09-006278, Jan. 10, 1997.
English Abstract for Publication No. 09-330054, Dec. 22, 1997.
English Abstract for Publication No. 1020000021177, Apr. 15, 2004.

* cited by examiner

*Primary Examiner*—Duc Q Dinh
(74) *Attorney, Agent, or Firm*—F. Chau & Associates, LLC

(57) ABSTRACT

A display driving integrated circuit (IC) and a display driving method for supporting various driving mode include an input unit, a digital-analog converter and a row data output unit. The row data output unit outputs at least one of the row data to a row line corresponding thereto for each row scan clock pulse. The row data output unit activates output paths for outputting the row data to the row lines in an activation order of a driving mode selected from a plurality of driving modes having different orders of activating the output paths in response to a mode select signal.

23 Claims, 9 Drawing Sheets

FIG. 1B (PRIOR ART)

| OUTPUT PAD | OUTPUT PAD GROUP | ACTIVATION ORDER | OUTPUT PAD | OUTPUT PAD GROUP | ACTIVATION ORDER |
|---|---|---|---|---|---|
| A1 (OP1~ OP66) | OP1G | 1 | A2 (OP67~ OP132) | OP23G | 23 |
| | OP2G | 2 | | OP24G | 24 |
| | OP3G | 3 | | OP25G | 25 |
| | OP4G | 4 | | OP26G | 26 |
| | OP5G | 5 | | OP27G | 27 |
| | OP6G | 6 | | OP28G | 28 |
| | OP7G | 7 | | OP29G | 29 |
| | OP8G | 8 | | OP30G | 30 |
| | OP9G | 9 | | OP31G | 31 |
| | OP10G | 10 | | OP32G | 32 |
| | OP11G | 11 | | OP33G | 33 |
| | OP12G | 12 | | OP34G | 34 |
| | OP13G | 13 | | OP35G | 35 |
| | OP14G | 14 | | OP36G | 36 |
| | OP15G | 15 | | OP37G | 37 |
| | OP16G | 16 | | OP38G | 38 |
| | OP17G | 17 | | OP39G | 39 |
| | OP18G | 18 | | OP40G | 40 |
| | OP19G | 19 | | OP41G | 41 |
| | OP20G | 20 | | OP42G | 42 |
| | OP21G | 21 | | OP43G | 43 |
| | OP22G | 22 | | OP44G | 44 |

FIG. 2B (PRIOR ART)

| OUTPUT PAD | OUTPUT PAD GROUP | ACTIVATION ORDER | OUTPUT PAD | OUTPUT PAD GROUP | ACTIVATION ORDER |
|---|---|---|---|---|---|
| A1 | OP1G | 1 | A1 | OP23G | 23 |
| A2 | OP2G | 2 | A2 | OP24G | 24 |
| A1 | OP3G | 3 | A1 | OP25G | 25 |
| A2 | OP4G | 4 | A2 | OP26G | 26 |
| A1 | OP5G | 5 | A1 | OP27G | 27 |
| A2 | OP6G | 6 | A2 | OP28G | 28 |
| A1 | OP7G | 7 | A1 | OP29G | 29 |
| A2 | OP8G | 8 | A2 | OP30G | 30 |
| A1 | OP9G | 9 | A1 | OP31G | 31 |
| A2 | OP10G | 10 | A2 | OP32G | 32 |
| A1 | OP11G | 11 | A1 | OP33G | 33 |
| A2 | OP12G | 12 | A2 | OP34G | 34 |
| A1 | OP13G | 13 | A1 | OP35G | 35 |
| A2 | OP14G | 14 | A2 | OP36G | 36 |
| A1 | OP15G | 15 | A1 | OP37G | 37 |
| A2 | OP16G | 16 | A2 | OP39G | 38 |
| A1 | OP17G | 17 | A1 | OP39G | 39 |
| A2 | OP18G | 18 | A2 | OP40G | 40 |
| A1 | OP19G | 19 | A1 | OP41G | 41 |
| A2 | OP20G | 20 | A2 | OP42G | 42 |
| A1 | OP21G | 21 | A1 | OP43G | 43 |
| A2 | OP22G | 22 | A2 | OP44G | 44 |

FIG. 6

| OUTPUT PATH | OUTPUT PATH GROUP | XMODE="L" | XMODE="H" | OUTPUT PATH | OUTPUT PATH GROUP | XMODE="L" | XMODE="H" |
|---|---|---|---|---|---|---|---|
| COM0 | COM0G | 1 | 1 | COM66 | COM22G | 23 | 2 |
| COM1 | | | | COM67 | | | |
| COM2 | | | | COM68 | | | |
| COM3 | COM1G | 2 | 3 | COM69 | COM23G | 24 | 4 |
| COM4 | | | | COM70 | | | |
| COM5 | | | | COM71 | | | |
| COM6 | COM2G | 3 | 5 | COM72 | COM24G | 25 | 6 |
| COM7 | | | | COM73 | | | |
| COM8 | | | | COM74 | | | |
| COM9 | COM3G | 4 | 7 | COM75 | COM25G | 26 | 8 |
| COM10 | | | | COM76 | | | |
| COM11 | | | | COM77 | | | |
| COM12 | COM4G | 5 | 9 | COM78 | COM26G | 27 | 10 |
| COM13 | | | | COM79 | | | |
| COM14 | | | | COM80 | | | |
| COM15 | COM5G | 6 | 11 | COM81 | COM27G | 28 | 12 |
| COM16 | | | | COM82 | | | |
| COM17 | | | | COM83 | | | |
| COM18 | COM6G | 7 | 13 | COM84 | COM28G | 29 | 14 |
| COM19 | | | | COM85 | | | |
| COM20 | | | | COM86 | | | |
| COM21 | COM7G | 8 | 15 | COM87 | COM29G | 30 | 16 |
| COM22 | | | | COM88 | | | |
| COM23 | | | | COM89 | | | |
| COM24 | COM8G | 9 | 17 | COM90 | COM30G | 31 | 18 |
| COM25 | | | | COM91 | | | |
| COM26 | | | | COM92 | | | |
| COM27 | COM9G | 10 | 19 | COM93 | COM31G | 32 | 20 |
| COM28 | | | | COM94 | | | |
| COM29 | | | | COM95 | | | |
| COM30 | COM10G | 11 | 21 | COM96 | COM32G | 33 | 22 |
| COM31 | | | | COM97 | | | |
| COM32 | | | | COM98 | | | |
| COM33 | COM11G | 12 | 23 | COM99 | COM33G | 34 | 24 |
| COM34 | | | | COM100 | | | |
| COM35 | | | | COM101 | | | |
| COM36 | COM12G | 13 | 25 | COM102 | COM34G | 35 | 26 |
| COM37 | | | | COM103 | | | |
| COM38 | | | | COM104 | | | |
| COM39 | COM13G | 14 | 27 | COM105 | COM35G | 36 | 28 |
| COM40 | | | | COM106 | | | |
| COM41 | | | | COM107 | | | |
| COM42 | COM14G | 15 | 29 | COM108 | COM36G | 37 | 30 |
| COM43 | | | | COM109 | | | |
| COM44 | | | | COM110 | | | |
| COM45 | COM15G | 16 | 31 | COM111 | COM37G | 38 | 32 |
| COM46 | | | | COM112 | | | |
| COM47 | | | | COM113 | | | |
| COM48 | COM16G | 17 | 33 | COM114 | COM38G | 39 | 34 |
| COM49 | | | | COM115 | | | |
| COM50 | | | | COM116 | | | |
| COM51 | COM17G | 18 | 35 | COM117 | COM39G | 40 | 36 |
| COM52 | | | | COM118 | | | |
| COM53 | | | | COM119 | | | |
| COM54 | COM18G | 19 | 37 | COM120 | COM40G | 41 | 38 |
| COM55 | | | | COM121 | | | |
| COM56 | | | | COM122 | | | |
| COM57 | COM19G | 20 | 39 | COM123 | COM41G | 42 | 40 |
| COM58 | | | | COM124 | | | |
| COM59 | | | | COM125 | | | |
| COM60 | COM20G | 21 | 41 | COM126 | COM42G | 43 | 42 |
| COM61 | | | | COM127 | | | |
| COM62 | | | | COM128 | | | |
| COM63 | COM21G | 22 | 43 | COM129 | COM43G | 44 | 44 |
| COM64 | | | | COM130 | | | |
| COM65 | | | | COM131 | | | |

DISPLAY DRIVER IC AND DISPLAY DRIVING METHOD FOR SUPPORTING VARIOUS DRIVING MODES

CROSS-REFERENCE TO RELATED PATENT APPLICATION

This application claims the benefit of Korean Patent Application No. 10-2006-0004443, filed on Jan. 16, 2006, in the Korean Intellectual Property Office, the disclosure of which is herein incorporated by reference in its entirety.

BACKGROUND OF THE INVENTION

1. Field of the Invention

The present invention relates to a display driver integrated circuit (IC), and more particularly, to a display driver IC and a display driving method for supporting various driving modes.

2. Description of Related Art

A display driver IC in a mobile device is constructed in one chip. The display driver IC converts digital video data to be displayed on a display panel into analog row data and analog column data having predetermined voltages. The display driver IC scans the row data and column data on the display panel. The column data is scanned to column lines of the display panel and the row data is scanned to row lines of the display panel.

The display driver IC receives the video data through input pads and outputs the row data and column data through output pads. Output pads outputting the column data can be located at the center of one side of the display driver IC and output pads outputting the row data can be located to both sides of the output pads outputting the column data. Interconnection lines connecting the output pads and the row lines of the display panel are arranged on a single layer. To substantially prevent the interconnection lines from being twisted the output pads outputting the row data are located at both ends of one side of the display driver IC.

The column data are simultaneously scanned to column lines corresponding thereto when all the output pads outputting the column data are activated. The row data are sequentially scanned to row lines corresponding thereto through output pads activated in a predetermined order. When first through nth (n is a natural number) row data respectively correspond to the row lines of a display panel, which are arranged in a predetermined order, for example, the first through nth row data are sequentially scanned to the row lines.

The display driver IC activates the output pads corresponding to the row data to scan the row data to the row lines. Here, the display driver IC can sequentially activate the output pads placed at one end of one side of the display driver IC and sequentially activate the output pads located at the other end.

Otherwise, the display driver IC can alternately activate the output pads located at both ends of one side of the display driver IC.

The order of activating output paths of the row data to scan the row data to corresponding row lines is fixed to the display driver IC. Therefore, a need exists for a chip and method for selecting the order of activating the output paths.

SUMMARY OF THE INVENTION

According to an embodiment of the present invention, a display driving IC includes an input unit a digital-analog converter and a row data output unit.

The input unit receives digital video data to be displayed on a panel. The digital-analog converter converts the digital video data into analog row data and analog column data respectively scanned to row lines and column lines of the panel. The row data output unit outputs at least one of the row data to a row line corresponding thereto for each row scan clock pulse.

The row data output unit activates output paths for outputting the row data to the row lines in an activation order of a driving mode selected from a plurality of driving modes having different orders of activating the output paths in response to a mode select signal.

According to an embodiment of the present invention, groups of three row data respectively corresponding to three adjacent row lines of 3n (n is a multiple of 2) row lines represent first through nth row data groups, and output paths for outputting the first through nth row data groups to the row lines represent first through nth output path groups the row data output unit activating at least one of the first through nth output path groups for each row scan clock pulse.

The row data output unit includes a plurality of counters and a decoder. The plurality of counters respectively correspond to the plurality of driving modes each driving mode corresponding to a respective activation order. The decoder activates output path groups corresponding to numbers representing the activation order, which are output from a counter selected from the plurality of counters. One of the plurality of counters is selected in response to the mode select signal.

The plurality of driving modes include first and second modes. The first mode sequentially activates the first through nth output path groups. The second mode alternately activates a first output part including the first through (n/2)th output path groups and a second output part including the {(n/2)+1}th through nth output path groups.

The counters include a first counter outputting the activation order of the first mode and a second counter outputting the activation order of the second mode. One of the first and second counters is selected in response to a logic level of the mode select signal.

The row data output unit includes a plurality of decoders. The plurality of decoders activating the output path groups in the activation orders of the driving modes respectively correspond thereto among the plurality of driving modes. One of the plurality of decoders is selected in response to the mode select signal.

The plurality of driving modes include first and second modes. The first mode sequentially activates the first through nth output path groups. The second mode alternately activates a first output part including the first through (n/2)th output path groups and a second output part including the {(n/2)+1}th through nth output path groups.

The decoders include a first decoder activating the output path groups in the activation order of the first mode and a second decoder activating the output path groups in the activation order of the second mode. One of the first and second decoders is selected in response to a logic level of the mode select signal.

The display driver IC drives an STN panel including 132 row lines.

The display driver IC further includes a mode select signal generator transmitting the mode select signal to the row data output unit in response to a control signal. The input unit includes a plurality of pads receiving the video data and the control signal. The control signal is applied to the display driver IC as different voltages. The control signal may be provided by an external control unit.

The row data output unit sequentially scans the row data to corresponding row lines in the order of a scan mode. The display driver IC further includes a column data output unit simultaneously outputting the column data to the column lines.

According to another embodiment of the present invention, a display driving method using a display driver IC includes receiving digital video data to be displayed on a panel, converting the digital video data into analog row data and analog column data respectively scanned to row lines and column lines of the panel selecting one of a plurality of driving modes having different orders of activating output paths, activating the output paths in the order of the selected driving mode, and outputting at least one of the row data to a row line corresponding thereto through the activated output paths.

The activating of the output paths in the order of the selected driving mode activates at least one of first through nth output path groups for each row scan clock pulse, wherein groups of three row data respectively corresponding to three adjacent row lines of 3n (n is a multiple of 2) row lines represent first through nth row data groups, and wherein the output paths outputting the first through nth row data groups to the row lines represent first through nth output path groups.

A plurality of counters of the display driver IC output the activation orders of driving modes corresponding thereto among the plurality of driving modes. The activating of the output paths in the order of the selected driving mode activates the output paths in an activation order output from a counter corresponding to the selected driving mode among the plurality of counters.

The plurality of driving modes include first and second modes. The first mode sequentially activates the first through nth output path groups. The second mode alternately activating a first output part including the first through (n/2)th output path groups and a second output part including the {(n/2)+1}th through nth output path groups.

The plurality of counters include a first counter outputting the activation order of the first mode and a second counter outputting the activation order of the second mode.

A plurality of decoders of the display driver IC activate the output path groups in the orders of driving modes respectively corresponding thereto among the plurality of driving modes. The activating of the output paths in the order of the selected driving mode activates the output paths by a decoder corresponding to the selected driving mode among the plurality of decoders.

The plurality of driving modes include first and second modes. The first mode sequentially activates the first through nth output path groups. The second mode alternately activates a first output part including the first through (n/2)th output path groups and a second output part including the {(n/2)+1}th through nth output path groups.

The plurality of decoders include a first decoder activating the output path groups in the activation order of the first mode and a second decoder activating the output path groups in the activation order of the second mode.

The selecting of the one of the plurality of driving modes selects one of the driving modes in response to a mode select signal that is provided by an external control unit to the display driver IC or applied to the display driving IC by making voltages of input pads of the display driver IC different.

The display driving method further comprises simultaneously scanning the column data to the column lines.

BRIEF DESCRIPTION OF THE DRAWINGS

The present invention will become more apparent by describing in detail exemplary embodiments thereof with reference to the attached drawings in which:

FIG. 1*b* is a table representing an order of output pads of the conventional display driver IC, which are activated according to the sequential driving mode of FIG. 1*a,*

FIG. 2*b* is a table representing an order of output pads of the conventional display driver IC, which are activated according to the zigzag driving mode of FIG. 2*a;*

FIG. 6 is a table representing an order of output pads activated according to driving modes in the display driver IC of FIG. 3.

DETAILED DESCRIPTION OF PREFERRED EMBODIMENTS

Figure 1A:
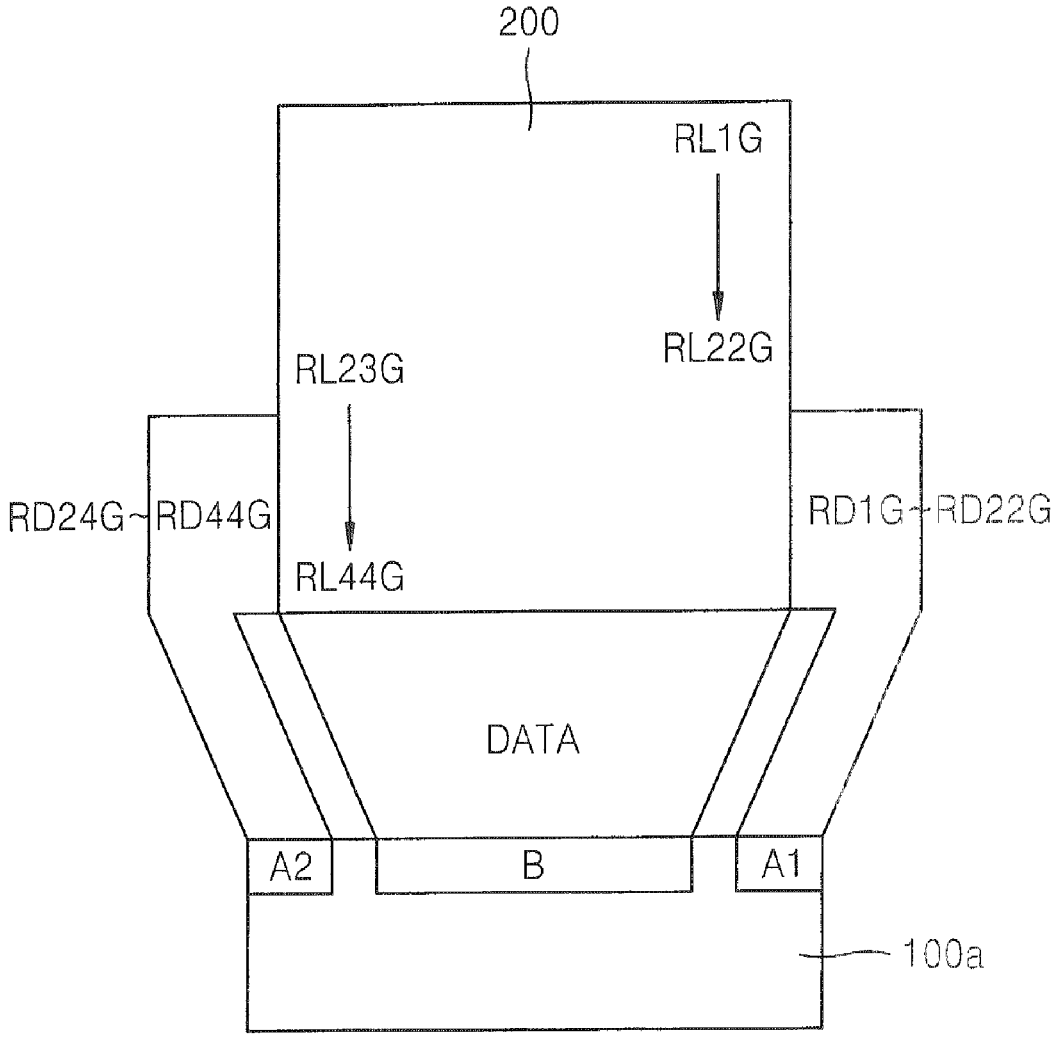
FIG. 1A (PRIOR ART)
FIG. 1*a* illustrates a sequential driving mode in a conventional display driver IC.

The present invention will now be described more fully with reference to the accompanying drawings, in which exemplary embodiments of the invention are shown. The invention may, however, be embodied in many different forms and should not be construed as being limited to embodiments set forth herein; rather, embodiments are provided so that this disclosure will be thorough and complete and will fully convey the concept of the invention to those skilled in the art. Throughout the drawings, like reference numerals refer to like elements.

FIG. 1*a* illustrates a sequential driving mode in a display driver IC 100*a*, and FIG. 1*b* is a table representing an order of output pads of the display driver IC 100*a*, which are activated according to the sequential driving mode of FIG. 1*a.*

Figure 2A:
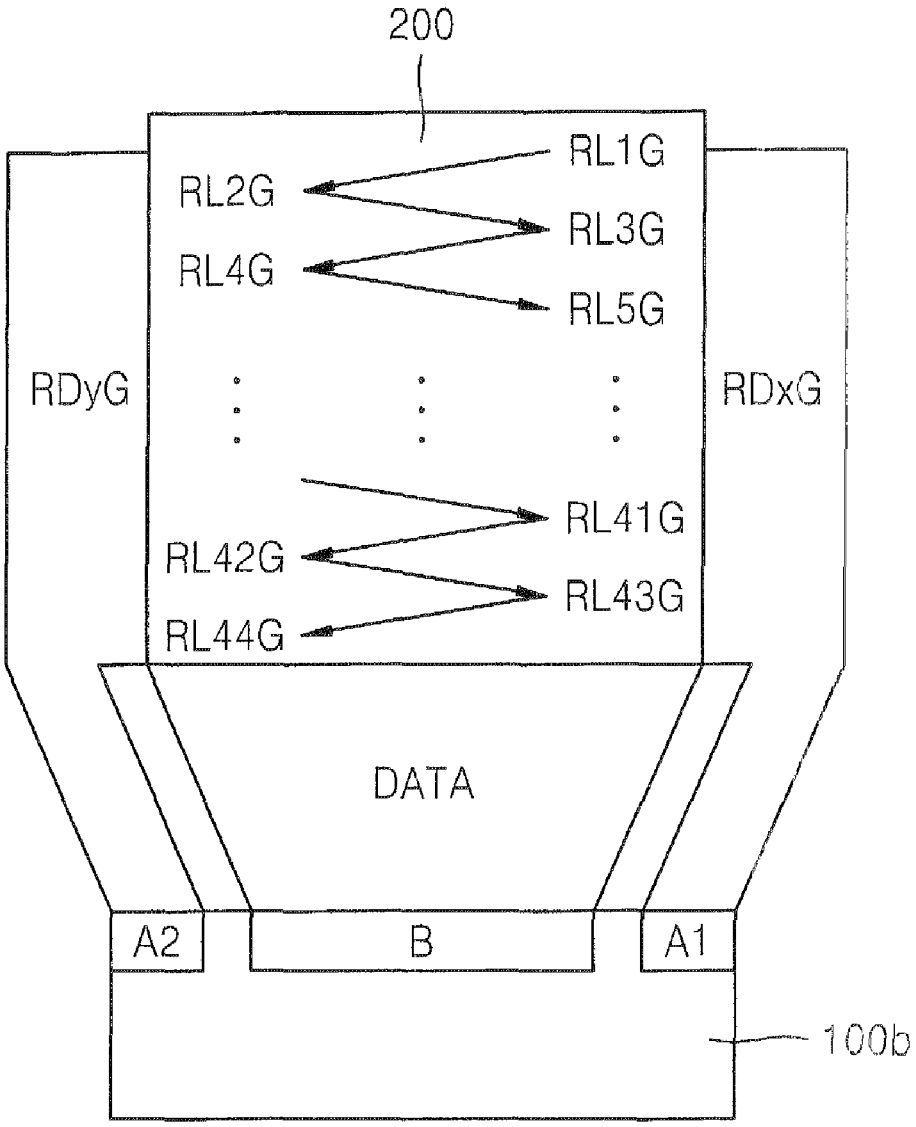
FIG. 2A (PRIOR ART)
FIG. 2*a* illustrates a zigzag driving mode in a conventional display driver IC.

Referring to FIGS. 1*a* and 1*b*, the display driver IC 100*a* drives a panel 200 including 132 row lines. FIGS. 1*a* and 2*a* represent Indium-Tin Oxide (ITO) lines connecting output pads A1, A2 and B to row and column lines on a plane for convenience of explanation.

Assume that 44 row line groups RLiG (i is a natural number corresponding to 132 or less) that are obtained by dividing the 132 row lines into groups of 3 adjacent row lines are numbered from the top of the panel 200. Row data groups RDiG are scanned to corresponding row line groups RLiG through corresponding row output pad groups OPiG. The display driver IC 100*a* activates one of the row output pad groups OPiG to scan the row data group corresponding thereto for each row scan clock pulse.

Column output pads B outputting column data CTDA are located at the center of one side of the display driver IC 100*a* and row output pads A1 and A2 outputting the row data RDiG are respectively located at both sides of the column output pads B. The row output pads A1 (referred to as "right pads" hereinafter) placed at the right of the column output pads B include first through twenty-second row output pads OP1G through OP22G outputting the first through twenty-second row data groups RD1G through RD22G. The row output pads A2 (referred to as "left pads" hereinafter) placed at the left of the column output pads B include twenty-third through forty-fourth row output pads OP23G through OP44G outputting the twenty-third through forty-fourth row data groups RD23G through RD44G.

The display driver IC 100*a* sequentially outputs the row data groups RDiG as shown in FIG. 1*b*. The display driver IC 100*a* sequentially activates the first through twenty-second row output pads OP1G through OP22G belonging to the right pads A1, and then sequentially activates the twenty-third through forty-fourth row output pads OP23G through OP44G belonging to the left pads A2. The display driver IC 100*a* repeats this operation to display an image corresponding to the input video data on the panel 200.

FIG. 2*a* illustrates a zigzag driving mode in a conventional display driver IC 100*b*, and FIG. 2*b* is a table representing an order of output pads of the display driver IC 100*b*, which are activated according to the zigzag driving mode of FIG. 2*a*. Referring to FIGS. 2*a* and 2*b*, the positions of output pads of the display driver IC 100*b* are identical to those of the display driver IC 100*a* of FIG. 1*a*. The right pads A1 of the display driver IC 100*b* include odd-numbered row output pad groups OPxG (x is an odd number between 1 and 132) outputting odd-numbered row data groups ROxG to odd-numbered row scan line groups RLxG. The left pad A2 of the display driver IC 100*b* include even-numbered row output pad groups OPyG (y is an even number between 1 and 132) outputting even-numbered row data groups RDyG to even-numbered row scan line groups RLyG. The right pads A1 include OP1G, OP3G, . . . , QP41G and OP43G and the left pads A2 include OP2G, OP4G, . . . , OP42G and OP44G. The right pads A1 output RD1G, RD3G, . . . , RD41G and RD43G and the left pads A2 output RD2G, RD4G, . . . , RD42G and RD44G.

Row data are sequentially scanned from the first row line. The display driver IC 110*b* alternately activates the right pads A1 and the left pads A2, as illustrated in FIG. 2*b*. The display driver IC 100*b* activates OP1G of the right pads A1 and then OP2G of the left pads A2. Subsequently, the display driver IC 100*b* activates QP3G of the right pad A1 and then OP4G of the left pads A2. In this manner, the display driver IC 100*b* activates the output pads.

However, the display driver IC 100*a* of FIG. 1*a* cannot support the driving mode of the display driver IC 100*b* of FIG. 2*a*. The display driver IC 100*a* of FIG. 1*a* activates the right pads A1 and then activates the left pads A2 but cannot support the zigzag driving mode of alternately activating the right pads A1 and the left pads A2.

The display driver IC 100*b* of FIG. 2*a* can support the zigzag driving mode but cannot support the sequential driving mode of the display driver IC 100*a* of FIG. 1*a*. Accordingly, to support a different driving mode, a different display driver IC design is needed.

Figure 3:
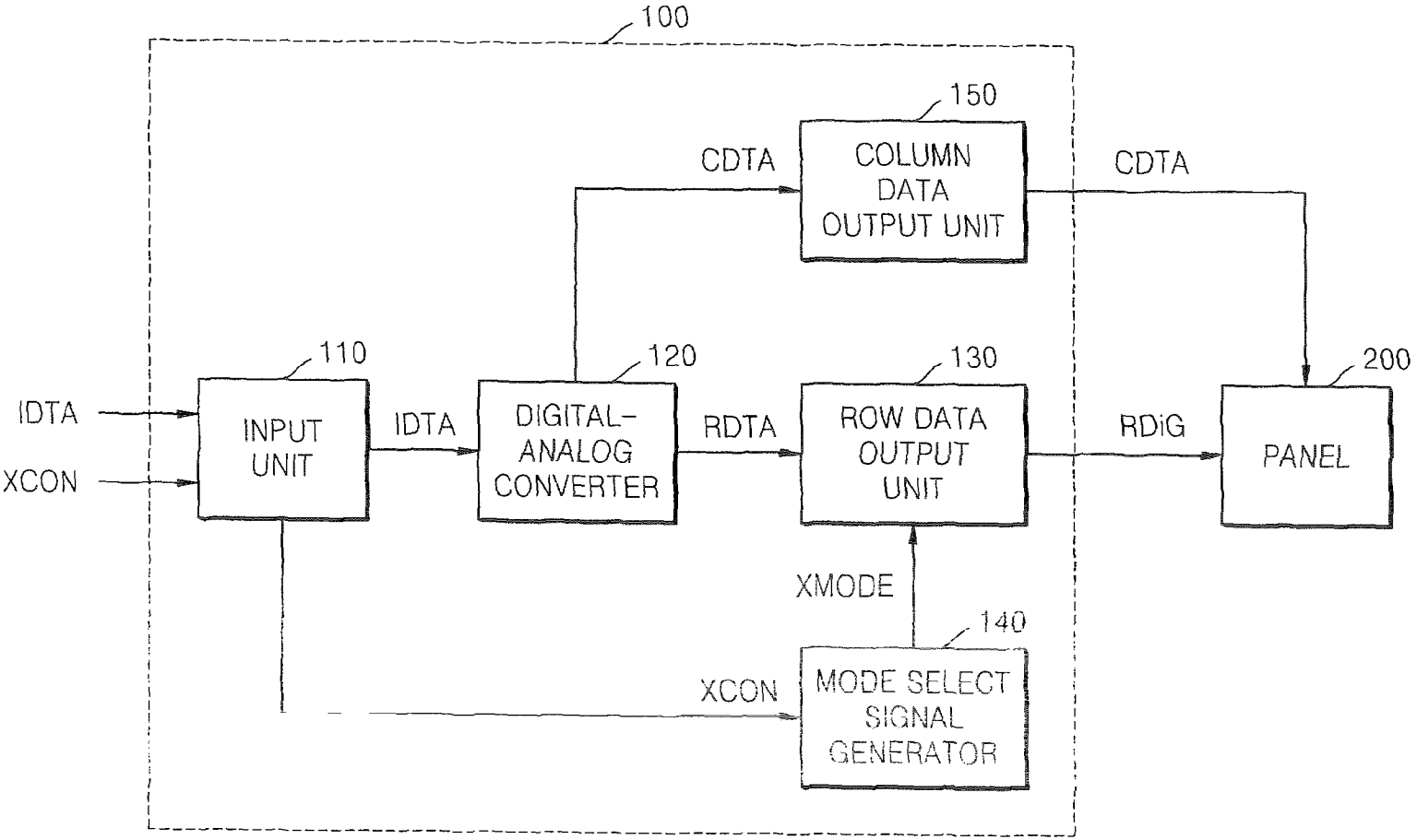
FIG. 3 is a block diagram of a display driver IC according to an embodiment of the present invention.

FIG. 3 is a block diagram of a display driver IC 100 according to an embodiment of the present invention. Referring to FIG. 3, the display driver IC 100 can select various scanning modes and includes an input unit 110, a digital-analog converter 120 and a row data output unit 130.

The input unit 110 receives digital video data IDTA to be displayed on a panel 200. The digital-analog converter 120 converts the digital video data IDTA to analog row data RDTA and analog column data CDTA to be respectively scanned to row lines and column lines of the panel 200.

For purposes of describing an exemplary display driver IC 100, assume that the display driver IC 100 is a display driver IC for driving a super twisted nematic (STN) panel including 132 row lines and that groups of three row data respectively corresponding to three adjacent row lines of the 132 (3n, n is a multiple of 2) row lines include first through nth row data groups RDiG (i is a natural number corresponding to 44 or less). The row data output unit 130 outputs at least one of the first through nth row data groups RDiG for each row scan clock pulse. The row data output unit 130 activates output paths outputting the row data RDTA to the row lines in an activation order of a driving mode that is selected from a plurality of driving modes having different orders of activating the output paths in response to a mode select signal XMODE. When the output paths outputting the first through nth row data groups RDiG to the row lines include first through nth output path groups, the row data output unit 130 activates at least one of the first through nth output path groups for each row scan clock pulse.

The plurality of driving modes can include first and second modes. The first mode sequentially activates the first through nth output path groups. The second mode alternately activates output path groups of a first output part and output path groups of a second output part when the first output part includes the first through (n/2)th output path groups and the second output part includes the {(n/2)+1}th through nth output path groups. For example, when n is 44, the first mode sequentially activates the first through forty-fourth output path groups and the second mode alternately activates the first output part including the first through twenty-second output path groups and the second output part including the twenty-third through forty-fourth output path groups.

For example, the second mode activates the first output path group of the first output part and then activates the twenty-third output path group of the second output part. Subsequently, the second mode activates the second output path group of the first output part and then activates the twenty-fourth output path group of the second output part. In this manner, the second mode alternately activates the output path groups of the first and second output parts and then activates the twenty-second output path group of the first output part and then the forty-fourth output path group of the second output part. The row data output unit 130 repeats the activation of the first through forty-fourth output path groups in the activation order of the first or second mode.

Figure 4:
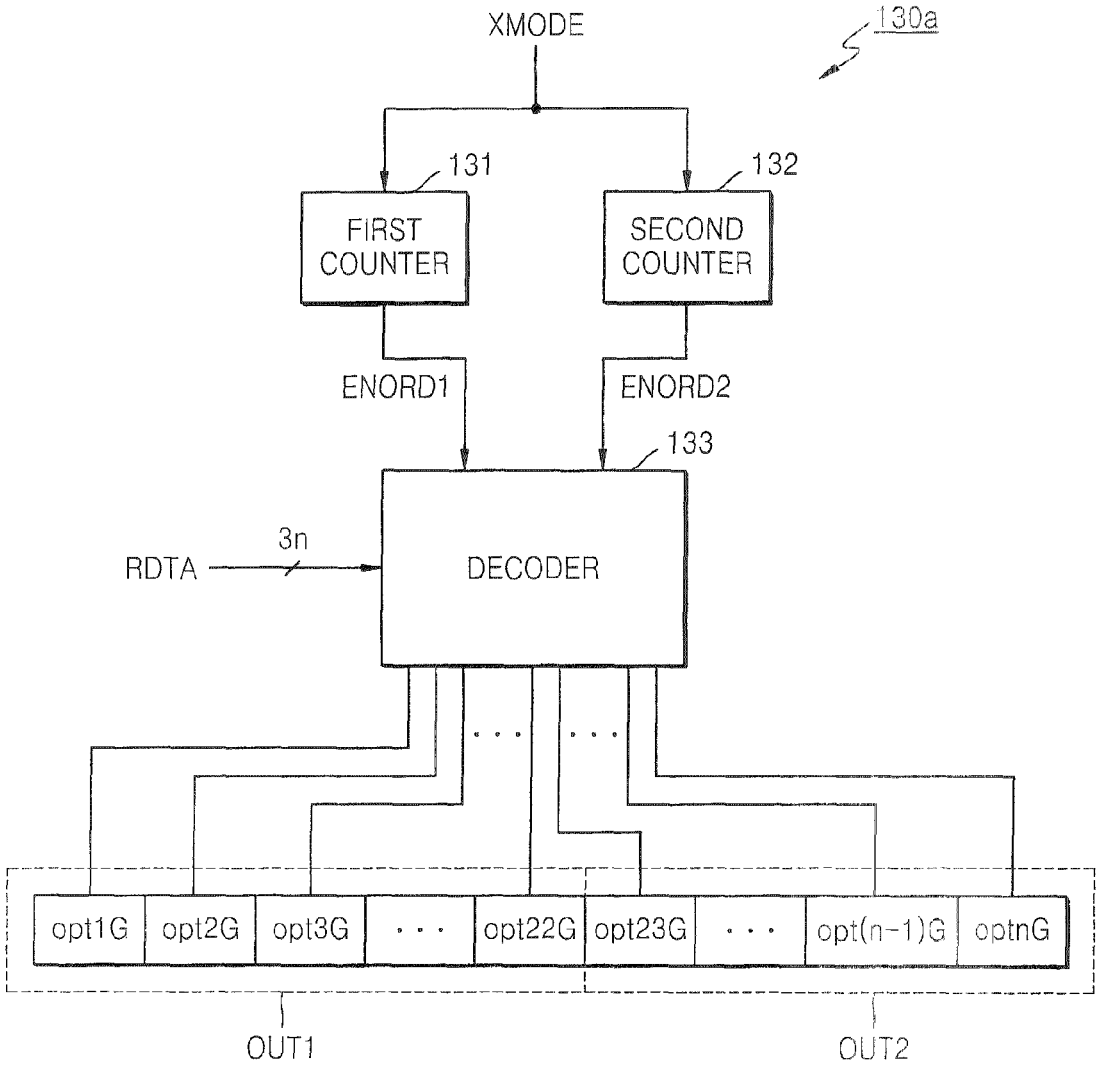
FIG. 4 is a block diagram of a row data output unit of the display driver IC of FIG. 3 according to an embodiment of the present invention.

FIG. 4 is a block diagram of a row data output unit 130*a* of the display driver IC 100 of FIG. 3 according to an embodiment of the present invention.

Referring to FIG. 4, the row data output unit 130*a* includes a plurality of counters 131 and 132 and a decoder 133. The row data output unit 13*a* can select one of the first and second modes.

Figure 5:
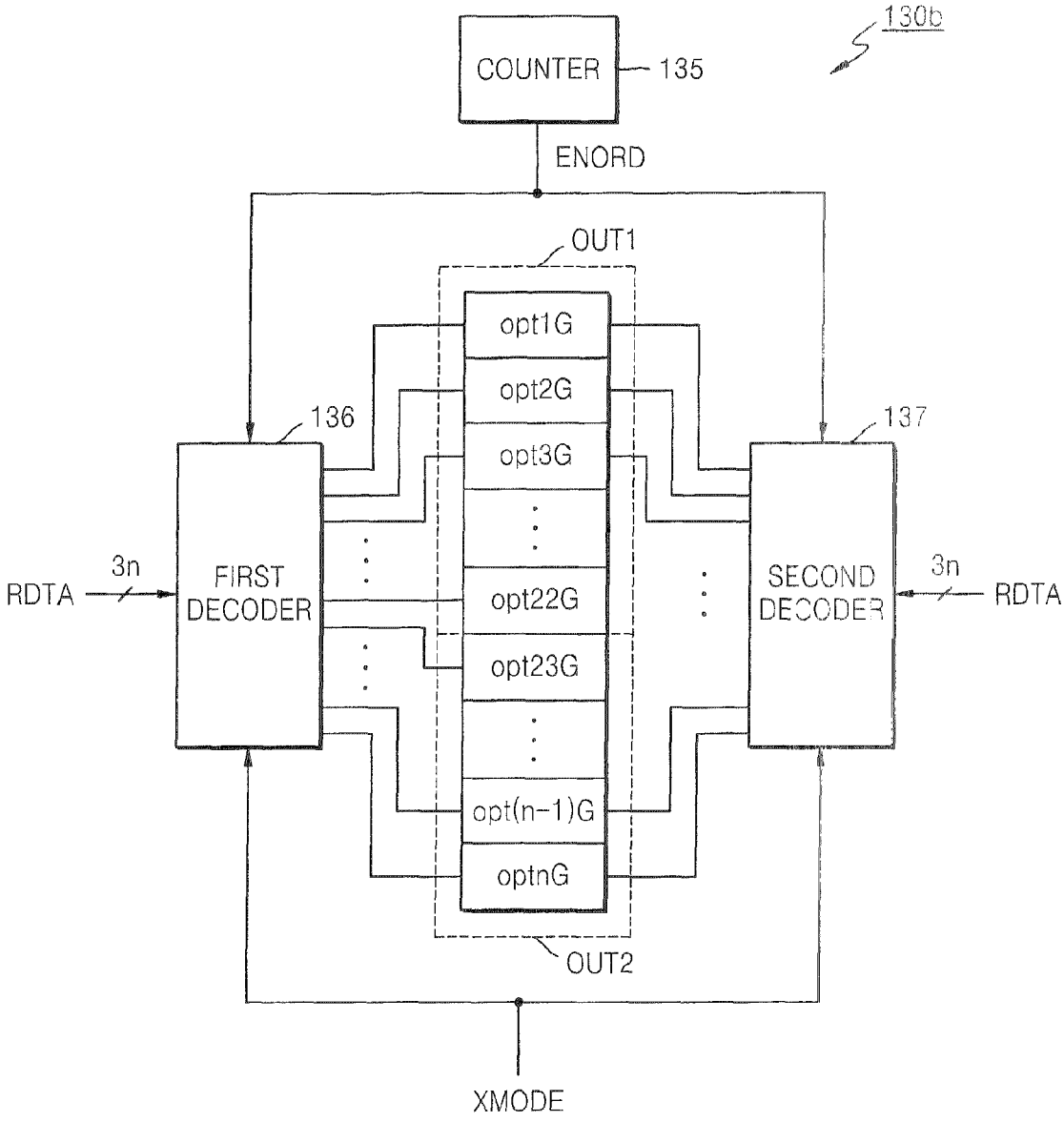
FIG. 5 is a block diagram of another row data output unit of the display driver IC of FIG. 3 according to another embodiment of the present invention.

While the output path groups include output lines and output pads outputting the row data groups RDiG, the output path groups are denoted by optiG representing the output pads in FIGS. 4 and 5 for convenience of explanation. The output path groups optiG can be divided into the first output part OUT1 including the first through twenty-second output path groups opt1G through opt22G and the second output part OUT2 including the twenty-third through forty-fourth output path groups opt23 through opt44. The first output part OUT1 can be a set of output paths including the right pads A1 of FIGS. 1*a* and 2*a* and the second output part OUT2 can be a set of output paths including the left pads A2 of FIGS. 1*a* and 2*a*.

The plurality of counters 131 and 132 respectively output activation orders of driving modes corresponding thereto. The counters 131 and 132 include a first counter 131 outputting the activation order of the first mode and a second counter 132 outputting the activation order of the second mode.

One of the first and second counters 131 and 132 is selected in response to the mode select signal XMODE. For example, the first counter 131 corresponding to the first mode is selected when the mode select signal XMODE is at a logic low level ("L") and the second counter 132 corresponding to the second mode is selected when the mode select signal XMODE is at a logic high level ("H").

Accordingly, when n is 44, the first counter 131 sequentially outputs 1, 2, 3, . . . , 43 and 44 and the second counter 132 sequentially outputs 1, 23, 2, 24, . . . , 22 and 44. Here, the counters 131 and 132 can represent the activation orders as 6-bit digital signals.

The decoder 133 activates the output path groups optiG in the activation order ENORD1 or ENORD2 output from the counter selected from the first and second counters 131 and 132. Specifically, the decoder 133 activates the output path groups optiG in the activation order ENORD1 of the first mode when the first counter 131 is selected and activates the output path groups optiG in the activation order ENORD2 of the second mode when the second counter 132 is selected.

The mode select signal XMODE at a logic low level ("L") is applied to the row data output unit 130*a* such that the first counter 131 sequentially outputs 1, 2, 3, . . . , 43 and 44 and the decoder 133 sequentially activates the first through nth output path groups optiG in the first mode. The mode select signal XMODE at a logic high level ("H") is applied to the row data output unit 130*a* such that the second counter 132 sequentially outputs 1, 23, 2, 24, . . . 22 and 44 and the decoder 133 alternately activates the output path groups optiG of the first and second output parts OUT1 and OUT2 in the second mode.

FIG. 5 is a block diagram of a row data output unit 130*b* of the display driver IC 100 of FIG. 3 according to another embodiment of the present invention.

Referring to FIG. 5, the row data output unit 130*b* includes a counter 135 and a plurality of decoders 136 and 137. The row data output unit 130*b* can select one of the first and second modes.

When n is 44, the counter 135 repeatedly outputs numbers 1 through 4. The plurality of decoders 136 and 137 activates output path groups optiG in the activation orders of driving modes corresponding thereto among the plurality of driving modes. The plurality of decoders 136 and 137 include a first decoder 136 that activates the output path groups optiG in the activation order of the first mode and a second decoder 137 that activates the output path groups optiG in the activation order of the second mode. The first decoder 136 corresponds to the first mode and the second decoder 137 corresponds to the second mode.

One of the first and second decoders 136 and 137 is selected in response to a mode select signal XMODE. The first decoder 136 activates output path groups optiG having the same numbers as the numbers ENORD output from the counter 135. The first decoder 136 sequentially activates first through forty-fourth output path groups optiG.

The second decoder 137 matches the numbers ENORD output from the counter 135 to the activation order of the second mode to activate output path groups optiG corresponding to the numbers ENORD. The second decoder 137 activates the first output path group opt1G when the counter 135 outputs "1", activates the twenty-third output path group opt23G when the counter 135 outputs "2", and activates the second output path group opt2G when the counter 135 outputs "3" In this manner, the second decoder 137 activates the output path groups optiG corresponding to "4" through "44" output from the counter 135.

The mode select signal XMODE at a logic low level ("L") is applied to the row data output unit 130*b* and the first decoder 136 sequentially activates the first through nth output path groups optiG in the first mode. The mode select signal XMODE at a logic high level ("H") is applied to the row data output unit 130*b* and the second decoder 137 alternately activates the output path groups optiG of the first and second output parts OUT1 and OUT2 in the second mode.

FIG. 6 is a table representing an order of output pads activated according to the first and second driving modes in the display driver IC 100 of FIG. 3. In FIG. 6, output pads represent the output paths. The table of FIG. 6 further represents driving operations of the display driver IC 100 of FIG. 3 in the first and second modes.

Referring to FIG. 3, the display driver IC 100 further includes a mode select signal generator 140. The mode select signal generator 140 transmits the mode select signal XMODE to the row data output unit 130 in response to a control signal XCON.

The input unit 110 includes a plurality of pads (not shown) for receiving the video data IDTA and the control signal XCON. The control signal XCON is applied to the display driver IC 100 by making voltages of pads receiving the control signal XCON different. When the plurality of driving modes include the first and second modes, the control signal XCON can have a logic low level ("L") or a logic high level ("H") by applying a power supply voltage VDD and a ground voltage GND to the pads.

The mode select signal XMODE can have the same logic level as the control signal XCON. The first mode may be selected by applying the ground voltage GND to the pads and the second mode may be selected by applying the power supply voltage VDD to the pads. The control signal XCON can be provided by an external control unit (not shown).

The display driver IC 100 further includes a column data output unit 150 for simultaneously outputting the column data CDTA to the column lines.

Figure 7:
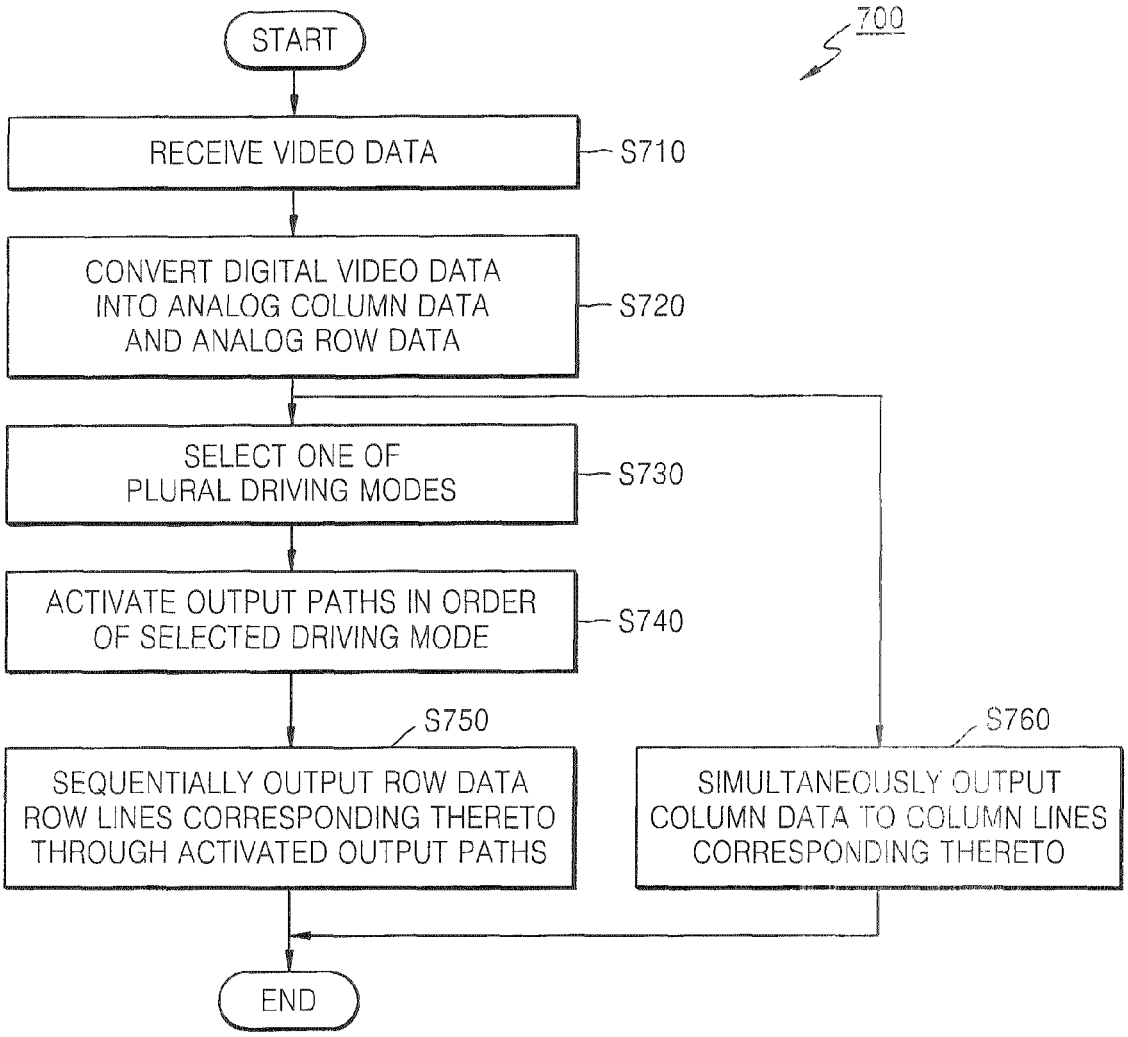
FIG. 7 is a flow chart of a display driving method according to an embodiment of the present invention.

FIG. 7 is a flow chart of a display driving method 700 according to an embodiment of the present invention. Referring to FIG. 7, the display driving method 700 uses a display driver IC including a plurality of counters or a plurality of decoders and includes receiving digital video data to be displayed on a panel at block S710, converting the digital video data into analog row data and analog column data respectively scanned to row lines and column lines of the panel at block S720, selecting a driving mode from a plurality of driving modes having different orders of activating output paths at block S730, activating the output paths in the order of the selected driving mode at block S740, and outputting at least one of the row data to a row line corresponding thereto through the activated output paths at block S750.

At least one of first through nth output path groups is activated for each row scan clock pulse at block S740. For purposes of the description, assume groups of three row data respectively corresponding to adjacent three row lines of 3n (n is a multiple of 2) row lines and include first through nth output path groups, the first through nth output path groups corresponding to output paths for outputting the first through nth row data groups to the row lines.

A plurality of counters output the activation orders of driving modes corresponding thereto among the plurality of driving modes. The output paths at activated at block S740 in the activation order output from a counter corresponding to the selected driving mode among the plurality of counters.

The plurality of driving modes include first and second modes. The first mode sequentially activates the first through nth output path groups. The second mode alternately activates first output part including the first through (n/2)th output path groups and the second output part including the {(n/2)+1}th through nth output path groups.

The plurality of counters include a first counter outputting the activation order of the first mode and a second counter outputting the activation order of the second mode.

A plurality of decoders activate the output path groups in the activation orders of driving modes corresponding thereto among the plurality of driving modes. The output paths are activated at block S740 by a decoder corresponding to the selected driving mode among the plurality of decoders.

The plurality of driving modes include first and second modes. The first mode sequentially activates the first through nth output path groups. The second mode alternately activates first output part including the first through (n/2)th output path groups and the second output part including the {(n/2)+1}th through nth output path groups.

The plurality of decoders include a first decoder activating the output path groups in the activation order of the first mode and a second decoder activating the output path groups in the activation order of the second mode.

One of the driving modes is selected at block S730 in response to a mode select signal. The mode select signal is provided by an external control unit to the display driver IC or applied to the display driving IC by making voltages of input pads of the display driver IC different.

The display driving method 700 further includes simultaneously scanning the column data to the column lines at block S760.

The display driving method for supporting various driving modes according to an embodiment of the present invention has the same technical spirit as that of the above-described display driver IC. Accordingly, those skilled in the art can understand the display driving method from the explanation of the aforementioned display driver IC so that detailed explanation thereof is omitted.

As described above, the display driver IC and display driving method according to an embodiment of the present invention can support various driving modes at the request of a user without needing a new chip design.

While the present invention has been particularly shown and described with reference to exemplary embodiments thereof, it will be understood by those of ordinary skill in the art that various changes in form and details may be made therein without departing from the spirit and scope of the disclosure.

What is claimed is:

1. A display driver integrated circuit (IC) comprising:

an input unit receiving digital video data to be displayed on a panel;

a digital-analog converter converting the digital video data into analog row data and analog column data respectively scanned to row lines and column lines of the panel; and a row data output unit outputting at least one of the row data to a row line corresponding thereto for each row scan clock pulse, wherein the row data output unit activates output paths for outputting the row data to the row lines in an activation order of a driving mode selected from a plurality of driving modes having different orders of activating the output paths in response to a mode select signal, wherein, assuming that groups of three row data respectively correspond to three adjacent row lines of 3n (n is a multiple of 2) row lines represent first through nth row data groups, and output paths for outputting the first through nth row data groups to the row lines represent first through nth output path groups the row data output unit activates at least one of the first through nth output path groups for each row scan clock pulse, and wherein the row data output unit comprises:

a plurality of counters respectively corresponding to the plurality of driving modes, each driving mode corresponding to a respective activation order; and a decoder activating output path groups corresponding to numbers representing the activation order, which are output from a counter selected from the plurality of counters, wherein one of the plurality of counters is selected in response to the mode select signal.

2. The display driver IC of claim 1, wherein the plurality of driving modes include first and second modes, the first mode sequentially activating the first through nth output path groups, the second mode alternately activating first and second output parts, the first output part including the first through (n/2)th output path groups, the second output part including the {(n/2)+1}th through nth output path groups.

3. The display driver IC of claim 2, wherein the counters include a first counter outputting the activation order of the first mode and a second counter outputting the activation order of the second mode.

4. The display driver IC of claim 3, wherein one of the first and second counters is selected in response to a logic level of the mode select signal.

5. The display driver IC of claim 1, wherein the row data output unit includes a plurality of decoders activating the output path groups in the activation orders of the driving modes respectively corresponding thereto among the plurality of driving modes, and wherein one of the plurality of decoders is selected in response to the mode select signal.

6. The display driver IC of claim 5, wherein the plurality of driving modes include first and second modes, the first mode sequentially activating the first through nth output path groups, the second mode alternately activating first and second output parts, the first output part including the first through (n/2)th output path groups, the second output pad including the {(n/2)+1}th through nth output path groups.

7. The display driver IC of claim 6, wherein the decoders include a first decoder activating the output path groups in the activation order of the first mode and a second decoder activating the output path groups in the activation order of the second mode.

8. The display driver IC of claim 7, wherein one of the first and second decoders is selected in response to a logic level of the mode select signal.

9. The display driver IC of claim 1, wherein the display driver IC drives a super twisted nematic (STN) panel including 132 row lines.

10. The display driver IC of claim 1, further comprising a mode select signal generator transmitting the mode select signal to the row data output unit in response to a control signal.

11. The display driver IC of claim 10, wherein the input unit comprises a plurality of pads receiving the video data and the control signal.

12. The display driver IC of claim 11, wherein the control signal is applied to the display driver IC as different voltages.

13. The display driver IC of claim 10, wherein the control signal is provided by an external control unit.

14. The display driver IC of claim 1, wherein the row data output unit sequentially scans the row data to corresponding row lines in the order of a scan mode.

15. The display driver IC of claim 1, further comprising a column data output unit simultaneously outputting the column data to the column lines.

16. A display driving method using a display driver integrated circuit (IC) comprising:

receiving digital video data to be displayed on a panel;

converting the digital video data into analog row data and analog column data respectively scanned to row lines and column lines of the panel;

selecting one of a plurality of driving modes having different orders of activating output paths;

activating the output paths in the order of the selected driving mode; and outputting at least one of the row data to a row line corresponding thereto through the activated output paths, wherein the activating of the output paths in the order of the selected driving mode activates at least one of first through nth output path groups for each row scan clock pulse, wherein groups of three row data respectively corresponding to three adjacent row lines of 3n (n is a multiple of 2) row lines represent first through nth row data groups, and wherein the output paths outputting the first through nth row data groups to the row lines represent the first through nth output path groups, outputting by a plurality of counters of the display driver IC the activation orders of driving modes corresponding thereto among the plurality of driving modes, wherein the activating of the output paths in the order of the selected driving mode activates the output paths in an activation order output from a counter corresponding to the selected driving mode among the plurality of counters, and wherein the plurality of driving modes include first and second modes, the first mode sequentially activating the first through nth output path groups the second mode alternately activating first and second output parts, the first output part including the first through (n/2)th output path groups, the second output part including the {(n/2)+1}th through nth output path groups.

17. The display driving method of claim 16, wherein the plurality of counters include a first counter outputting the activation order of the first mode and a second counter outputting the activation order of the second mode.

18. The display driving method of claim 16, further comprising activating by a plurality of decoders of the display driver IC the output path groups in the orders of driving modes respectively corresponding thereto among the plurality of driving modes.

19. The display driving method of claim 18, wherein the activating of the output paths in the order of the selected driving mode activates the output paths by a decoder corresponding to the selected driving mode among the plurality of decoders.

20. The display driving method of claim 19, wherein the plurality of driving modes include first and second modes, the first mode sequentially activating the first through nth output path groups the second mode alternately activating first and second output parts the first output part including the first through (n/2)th output path groups, the second output part including the {(n/2)+1}th through nth output path groups.

21. The display driving method of claim 20, wherein the plurality of decoders include a first decoder activating the output path groups in the activation order of the first mode and a second decoder activating the output path groups in the activation order of the second mode.

22. The display driving method of claim 16, wherein the selecting of the one of the plurality of driving modes selects one of the driving modes in response to a mode select signal that is provided by an external control unit to the display driver IC or applied to the display driving IC by making voltages of input pads of the display driver IC different.

23. The display driving method of claim 16, further comprising simultaneously scanning the column data to the column lines.

* * * * *